US009297199B2

(12) United States Patent
Blackburn et al.

(10) Patent No.: US 9,297,199 B2
(45) Date of Patent: Mar. 29, 2016

(54) FRAME WITH FASTENERS SECURING ALIGNED MEMBERS AND METHODS FOR FORMING SAME

(71) Applicant: Houston Shutters, LLC, Houston, TX (US)

(72) Inventors: Michael Blackburn, Houston, TX (US); Jennifer Baur, Houston, TX (US)

(73) Assignee: HOUSTON SHUTTERS, LLC, Houston, TX (US)

( * ) Notice: Subject to any disclaimer, the term of this patent is extended or adjusted under 35 U.S.C. 154(b) by 173 days.

(21) Appl. No.: 13/907,205

(22) Filed: May 31, 2013

(65) Prior Publication Data

US 2014/0352217 A1 Dec. 4, 2014

(51) Int. Cl.
*E06B 7/08* (2006.01)
*E06B 7/086* (2006.01)

(52) U.S. Cl.
CPC ..... *E06B 7/086* (2013.01)

(58) Field of Classification Search
CPC ..... E06B 7/08; E06B 7/09
USPC ..... 49/74.1, 505; 52/202, 203, 473, 455, 52/456, 656.1, 656.2, 656.3, 656.4, 656.5, 52/656.6, 656.7, 656.8, 656.9
See application file for complete search history.

(56) References Cited

U.S. PATENT DOCUMENTS 2,575,004 A 11/1951 Condron, Jr.
3,553,891 A * 1/1971 Casebolt et al. ..... 49/505
3,691,687 A 9/1972 Economou
3,991,535 A * 11/1976 Keller et al. ..... 52/642
4,516,341 A 5/1985 Jenkins
4,592,402 A 6/1986 Spofford
4,652,170 A * 3/1987 Lew ..... 403/381
4,702,051 A * 10/1987 Miller ..... 52/202
4,714,373 A 12/1987 Heekin
4,718,184 A 1/1988 Sherman
4,956,956 A 9/1990 Maier et al.
5,191,735 A 3/1993 Ross (Continued)

FOREIGN PATENT DOCUMENTS

CA 2342839 A1 * 10/2001
DE 102004010474 A1 * 9/2005

(Continued)

OTHER PUBLICATIONS

Chinese Office Action dated Aug. 7, 2015, for Chinese Application No. 201410239964.1 (5 p.).

(Continued)

*Primary Examiner* — Jerry Redman
(74) *Attorney, Agent, or Firm* — Conley Rose, P.C.

(57) ABSTRACT

A frame assembly for windows and doors includes a pair of side members and a pair of generally parallel cross members, each extending along a unique member axis. The cross members include a first frame portion and a second frame portion that extend generally along the member axis and are connected by a camming fastener that draws together and secures the first and second frame portions. A method of fabricating a shutter assembly includes forming a pair of C-shaped partial-frames, each from a side member coupled to portions of two cross-members. The method includes co-axially aligning corresponding portions of the two cross-members along two axes and joining the two C-shaped partial-frames with camming fasteners.

9 Claims, 8 Drawing Sheets

(56) References Cited

U.S. PATENT DOCUMENTS

| | | | | |
|---|---|---|---|---|
| 5,379,551 | A * | 1/1995 | Swapp | 49/82.1 |
| 5,490,353 | A * | 2/1996 | McLaughlin | 49/64 |
| 5,778,598 | A | 7/1998 | Ohanesian | |
| 6,125,581 | A * | 10/2000 | Grossman | 49/74.1 |
| 6,219,985 | B1 | 4/2001 | Hsu | |
| 6,314,680 | B1 | 11/2001 | Buckwalter et al. | |
| 6,405,467 | B1 | 6/2002 | Dedlow | |
| 6,691,461 | B1 * | 2/2004 | Gitkin | 49/74.1 |
| 6,817,141 | B2 | 11/2004 | Chen | |
| 6,854,211 | B1 | 2/2005 | Blachley | |
| 6,865,847 | B2 | 3/2005 | Fraser et al. | |
| 6,883,277 | B2 | 4/2005 | Wiechecki et al. | |
| 6,890,121 | B2 | 5/2005 | Mauri | |
| 6,901,701 | B2 * | 6/2005 | Lee | 49/82.1 |
| 7,036,279 | B2 * | 5/2006 | Crozzoli | 52/213 |
| 7,353,636 | B1 | 4/2008 | Anderson et al. | |
| 7,392,628 | B2 | 7/2008 | Logan et al. | |
| 7,431,409 | B2 | 10/2008 | Yang | |
| 7,461,482 | B2 | 12/2008 | Cerasi et al. | |
| 7,921,602 | B2 | 4/2011 | Ohanesian | |
| 7,987,565 | B1 | 8/2011 | Blachley | |
| 8,273,145 | B2 | 9/2012 | Banks et al. | |
| 8,312,676 | B2 | 11/2012 | Maciulewicz | |
| 8,533,996 | B1 * | 9/2013 | Stone | 49/82.1 |
| 8,869,459 | B2 * | 10/2014 | Wei | 49/505 |
| 2002/0056230 | A1 * | 5/2002 | Horn et al. | 49/74.1 |
| 2004/0068936 | A1 * | 4/2004 | Amin-Javaheri | 49/74.1 |
| 2004/0168368 | A1 * | 9/2004 | Chen | 49/74.1 |
| 2005/0091924 | A1 | 5/2005 | Antonini | |
| 2005/0235562 | A1 * | 10/2005 | Hsu | 49/74.1 |
| 2006/0248801 | A1 * | 11/2006 | Marocco | 49/74.1 |
| 2007/0094954 | A1 | 5/2007 | Blackwell et al. | |
| 2008/0295406 | A1 * | 12/2008 | Kollman et al. | 49/74.1 |
| 2009/0065156 | A1 | 3/2009 | Roberts et al. | |
| 2011/0091269 | A1 | 4/2011 | Solly et al. | |
| 2011/0286792 | A1 | 11/2011 | Henriott et al. | |
| 2011/0302840 | A1 * | 12/2011 | Blachley | 49/74.1 |

FOREIGN PATENT DOCUMENTS

| | | | |
|---|---|---|---|
| EP | 0635088 | A1 | 1/1995 |
| WO | WO 2006071703 | A2 * | 7/2006 |

OTHER PUBLICATIONS

English Translation of Chinese Office Action dated Aug. 7, 2015, for Chinese Application No. 201410239964.1 (7 p.).

* cited by examiner

FRAME WITH FASTENERS SECURING ALIGNED MEMBERS AND METHODS FOR FORMING SAME

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

1. Field of the Disclosure

This disclosure relates generally to frames for holding objects or for aesthetically accenting objects. More particularly, it relates to frames for holding shutters and to assemblies of frames and shutters applicable for installation with windows and doors.

2. Background Information

The design, fabrication, assembly, and installation of shutters for window and door openings or casings, which in some instances is called fenestration, can add storm protection, privacy, or aesthetic beauty to homes and other buildings. Some shutter assemblies are functional, such as panels that pivotally mount to a window or door casing, allowing the panels to be selectively pivoted to cover the window or door opening or pivoted to the side of the opening. Other shutters are cosmetic, giving aesthetic appeal without allowing movement. Panels for functional or cosmetic shutters commonly include a series of louvers, e.g. over-lapping boards. For functional shutters, the louvers may be pivotable or rigid relative to a panel frame.

Design features that reduce manufacturing, assembly, and/or transportation costs and/or that simplify the assembly of shutters are desirable to maintain an economic advantage.

BRIEF SUMMARY OF THE DISCLOSURE

These and other needs in the art are addressed in one embodiment by a frame assembly. In an embodiment, the frame assembly comprises a pair of side members and a pair of generally parallel cross members extending between the side members and spaced apart from one another, each cross member extending along a unique member axis. At least a first of the cross members comprises a first frame portion and a second frame portion that extend generally along the first member axis, the first and second frame portions being joinable together at a joint by a first fastener. The fastener comprises a pin member extending from the end of the first frame portion in a direction generally parallel to the first member axis and insertable into a recess in the second frame portion. The fastener further comprises a receiving member having a cam surface engagable with the pin member and being mounted in and rotatable within the second frame portion and adapted to draw together the first and second frame portions when the receiving member is rotated while engaging the pin member.

In another embodiment, a shutter assembly comprises a frame and at least one panel pivotally coupled to the frame. The frame comprises a pair of side members and a pair of generally parallel cross members extending between the side members and spaced apart from one another, each cross member extending along a unique member axis. At least one of the cross members comprises a first frame portion and a second frame portion that extend generally along the first member axis, the first and a second frame portions being joined together at a joint held by a camming fastener. The camming fastener comprises a rotatable portion that is adapted for rotation about an axis of rotation perpendicular to the first member axis and that is adapted to draw together the first and the second frame portions when the receiving member is rotated and to secure the first and second portions to be generally aligned with the member axis.

A method of fabricating a shutter assembly is disclosed and includes forming a first C-shaped partial-frame having a first side member coupled to a first frame portion of an upper cross member and to a first frame portion of a lower cross member. The method further comprises forming a second C-shaped partial-frame having a second side member coupled to a second frame portion of the upper cross member and to a second frame portion of the lower cross member. In addition, the method comprises co-axially aligning the first and second frame portions of the upper cross member along an upper member axis and co-axially aligning the first and second frame portions of the lower cross member along a lower member axis. The method still further comprises coupling with a first camming fastener, the aligned first and second frame portions of the upper cross member, and coupling with a second camming fastener, the aligned first and second frame portions of the lower cross member.

Thus, embodiments described herein comprise a combination of features and characteristics intended to address various shortcomings associated with certain prior devices, systems, and methods. The various features and characteristics described above, as well as others, will be readily apparent to those of ordinary skill in the art upon reading the following detailed description, and by referring to the accompanying drawings.

BRIEF DESCRIPTION OF THE DRAWINGS

For a detailed description of the disclosed embodiments of the disclosure, reference will now be made to the accompanying drawings in which.

NOTATION AND NOMENCLATURE

Figure 1:
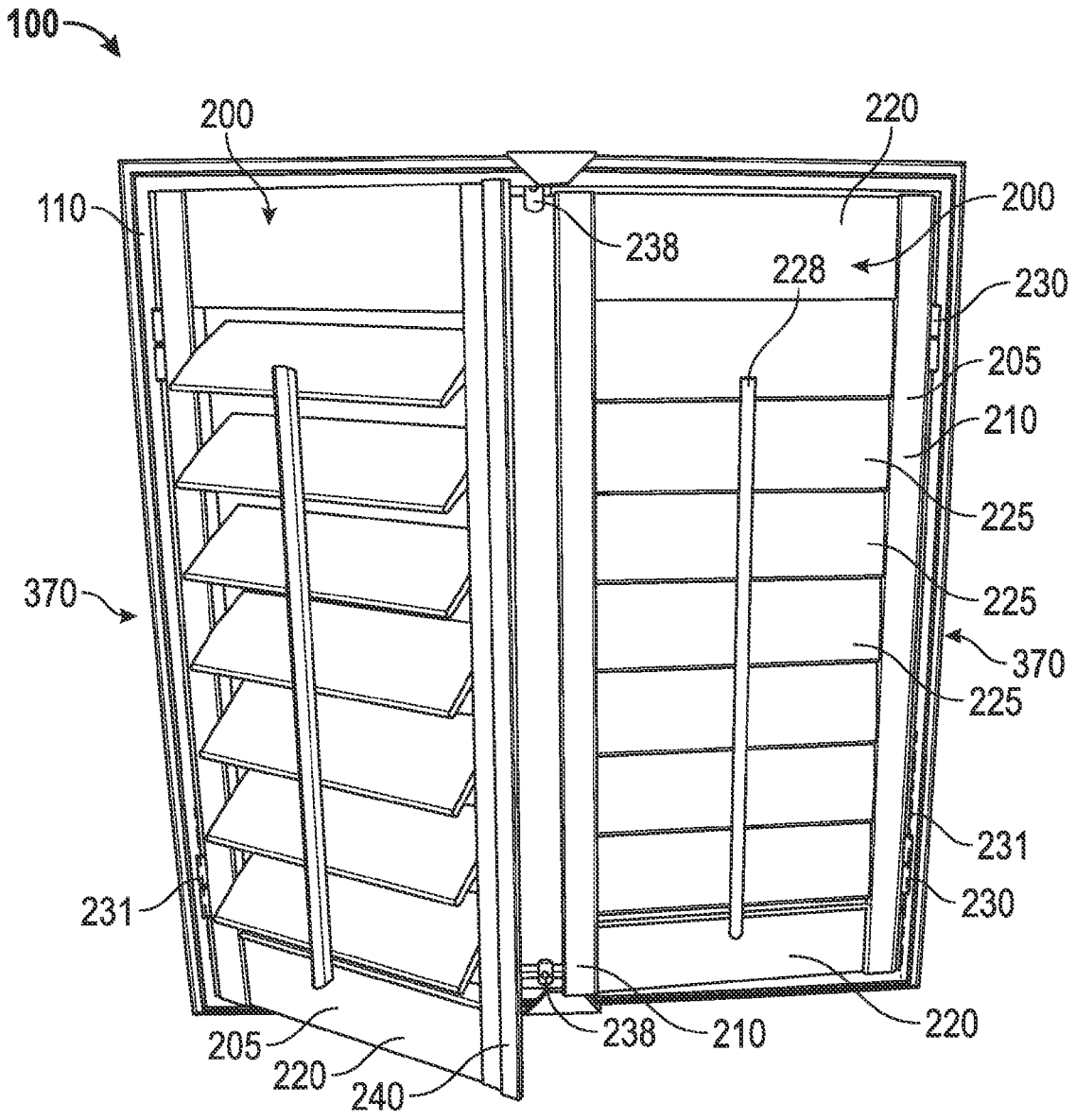
FIG. 1 is a perspective front view of a shutter assembly in accordance with principles described herein.

The following description is exemplary of embodiments of the disclosure. These embodiments are not to be interpreted or otherwise used as limiting the scope of the disclosure, including the claims. One of ordinary skill in the art will understand that the following description has broad application, and the discussion of any embodiment is meant only to be exemplary of that embodiment, and is not intended to suggest in any way that the scope of the disclosure, including the claims, is limited to that embodiment.

The drawing figures are not necessarily to scale. Certain features and components disclosed herein may be shown exaggerated in scale or in somewhat schematic form, and some details of conventional elements may not be shown in the interest of clarity and conciseness. In some of the figures, in order to improve clarity and conciseness of the figure, one or more components or aspects of a component may be omitted or may not have reference numerals identifying the features or components that are identified elsewhere. In addition, among the drawings, like or identical reference numerals may be used to identify common or similar elements.

The terms "including" and "comprising" are used herein, including in the claims, in an open-ended fashion, and thus should be interpreted to mean "including, but not limited to . . . . " Also, the term "couple" or "couples" is intended to mean either an indirect or direct connection. Thus, if a first component couples or is coupled to a second component, the connection between the components may be through a direct engagement of the two components, or through an indirect connection that is accomplished via other intermediate components, devices and/or connections. The recitation "based on" means "based at least in part on." Therefore, if X is based on Y, X may be based on Y and any number of other factors.

In addition, as used herein, the terms "axial" and "axially" generally mean along or parallel to a given axis (e.g., central axis of a body or a port), while the terms "radial" and "radially" generally mean perpendicular to the axis. For instance, an axial distance refers to a distance measured along or parallel to a given axis, and a radial distance means a distance measured perpendicular to the axis. Any reference to a relative direction with respect to an object, for example "top," "bottom," "up", "upward," "left," "leftward," "down", "lower", and "clock-wise," is made for purpose of clarification and pertains to the orientation as shown. If the object were viewed from another orientation or implemented in another orientation, it may be appropriate to described direction using an alternate term.

DETAILED DESCRIPTION OF THE DISCLOSED EMBODIMENTS

This disclosure presents a frame assembly and also a shutter assembly both applicable to window and door openings, frames, or casings. In various embodiments, the shutter assembly includes at least one panel coupled to the frame assembly, and the panel includes multiple louvers. The frame assembly is formed from two C-shaped partial-frames butted together and held at two joints. In certain embodiments, each joint is formed using a two-member, camming fastener; wherein, one fastening member grasps the other fastening member to pull the joint together. An example of a fastener compatible with the frame assembly and the shutter assembly is a cam lock fastener. In various embodiments, the panel is coupled to one of the C-shaped partial-frames, forming a shutter sub-assembly that is joinable to another such sub-assembly by the camming fasteners. In at least some embodiments, the shutter assembly is functional, meaning that the panel pivotally mounts to the frame assembly, allowing the panel to be selectively positioned within the window or door opening or to the side of the opening.

Figure 2:
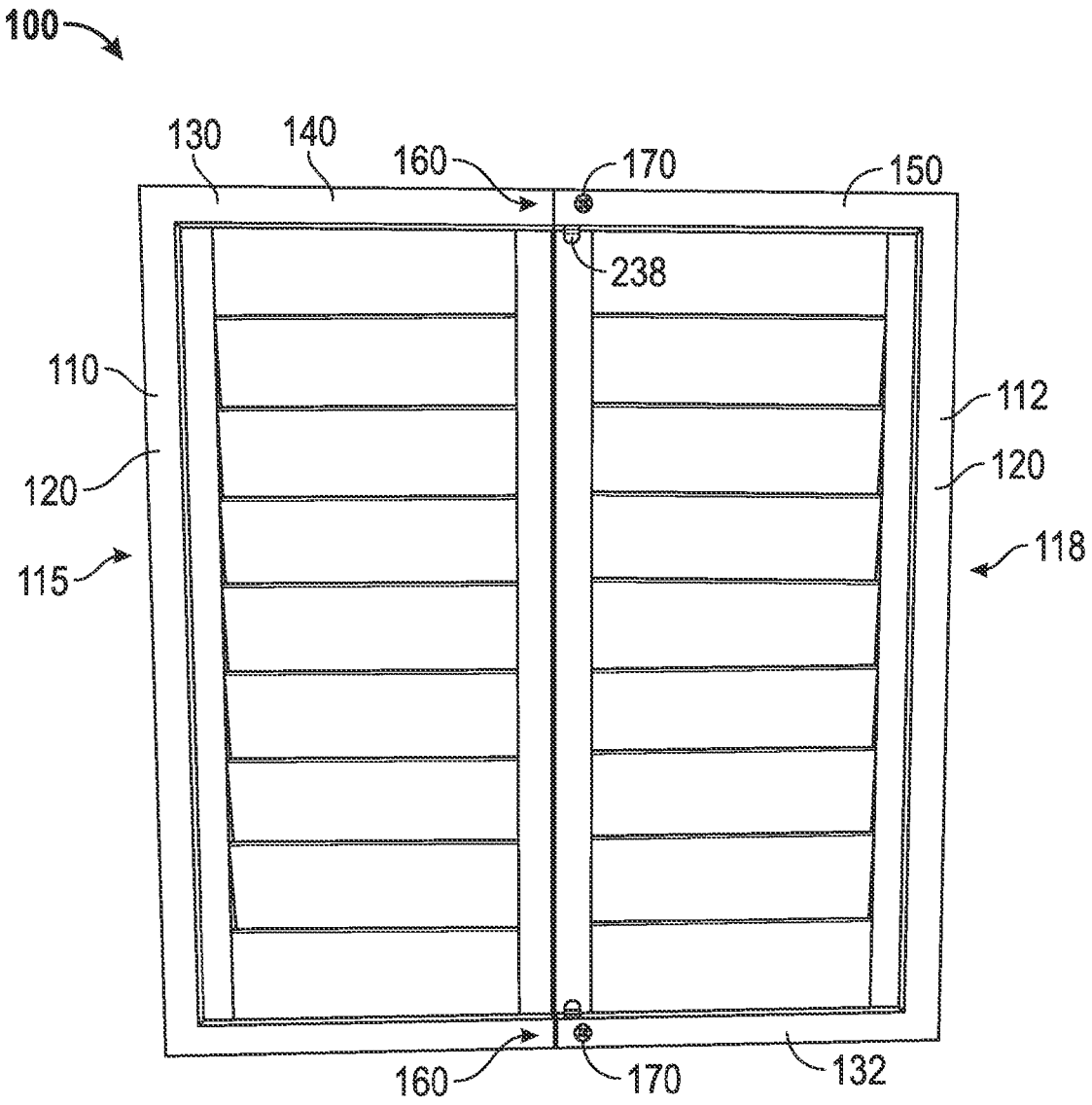
FIG. 2 is a rear elevation view of the shutter assembly of FIG. 1 in accordance with principles described herein.
Figure 3:
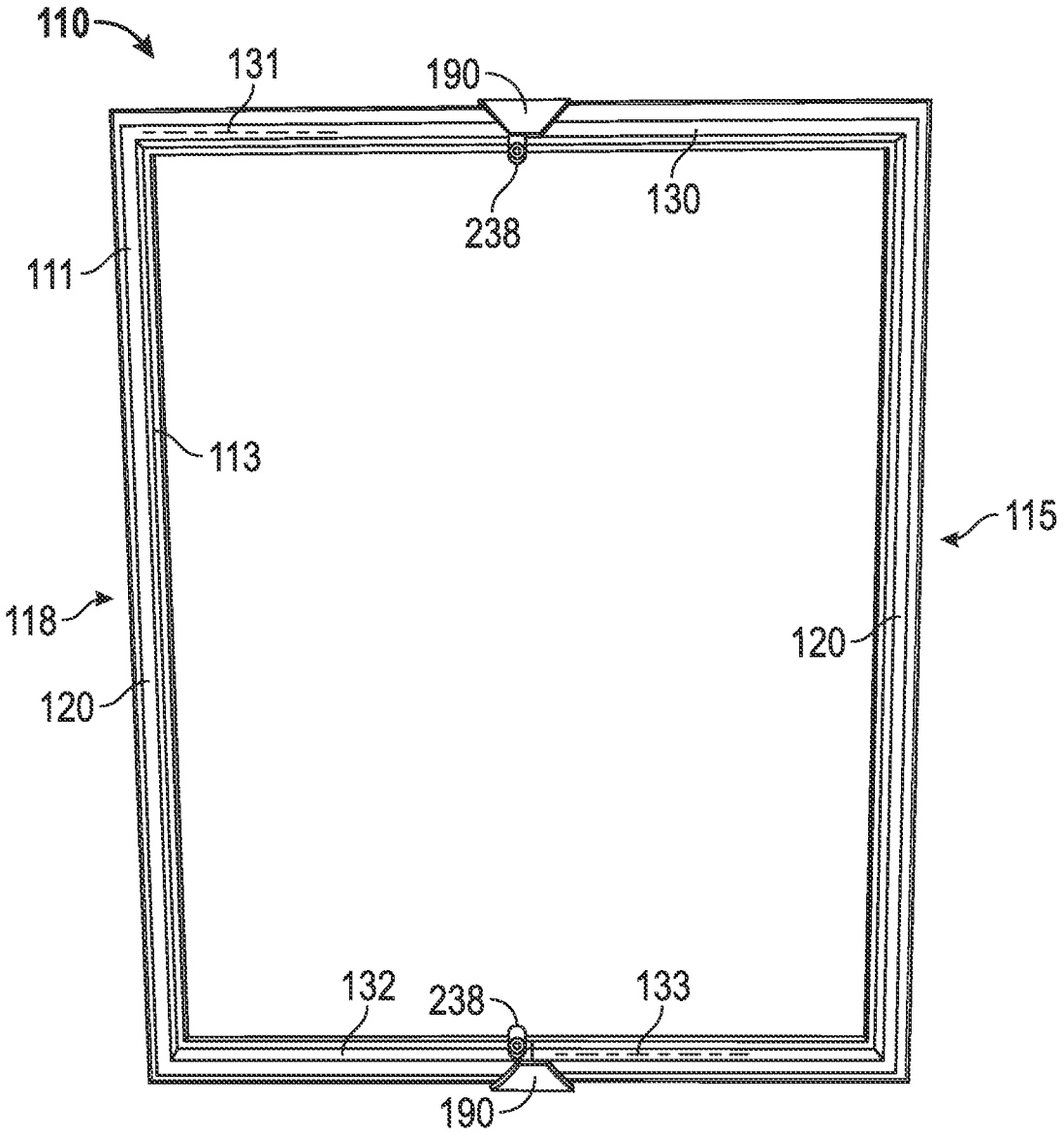
FIG. 3 is a front elevation view of a frame assembly of the shutter assembly of FIG. 1 in accordance with principles described herein.

Referring to FIG. 1 and FIG. 2, an exemplary embodiment of a shutter assembly is shown in perspective view. Shutter assembly 100 includes a frame 110 and multiple panels pivotally coupled to frame 110. In this embodiment, the panels are two louvered panels 200. Frame 110 will also be called frame assembly 110. Referring to FIG. 2 and FIG. 3, Frame 110 includes a front surface 111, a rear surface 112 opposite front surface 111, and end interior groove 113 facing front surface 111. Frame 110 further includes multiple side members and multiple cross members extending between the side members. In particular, the embodiment of FIG. 3 includes a pair of elongate side members 120, and a pair of elongate, generally parallel cross members 130, 132 extending between the side members 120. In the orientation shown, side members 120 are vertical, and cross members 130, 132 are horizontal. Cross members 130, 132 are spaced apart from one another, and each cross member extends along a unique longitudinal axis or member axis 131, 133, respectively.

Figure 4:
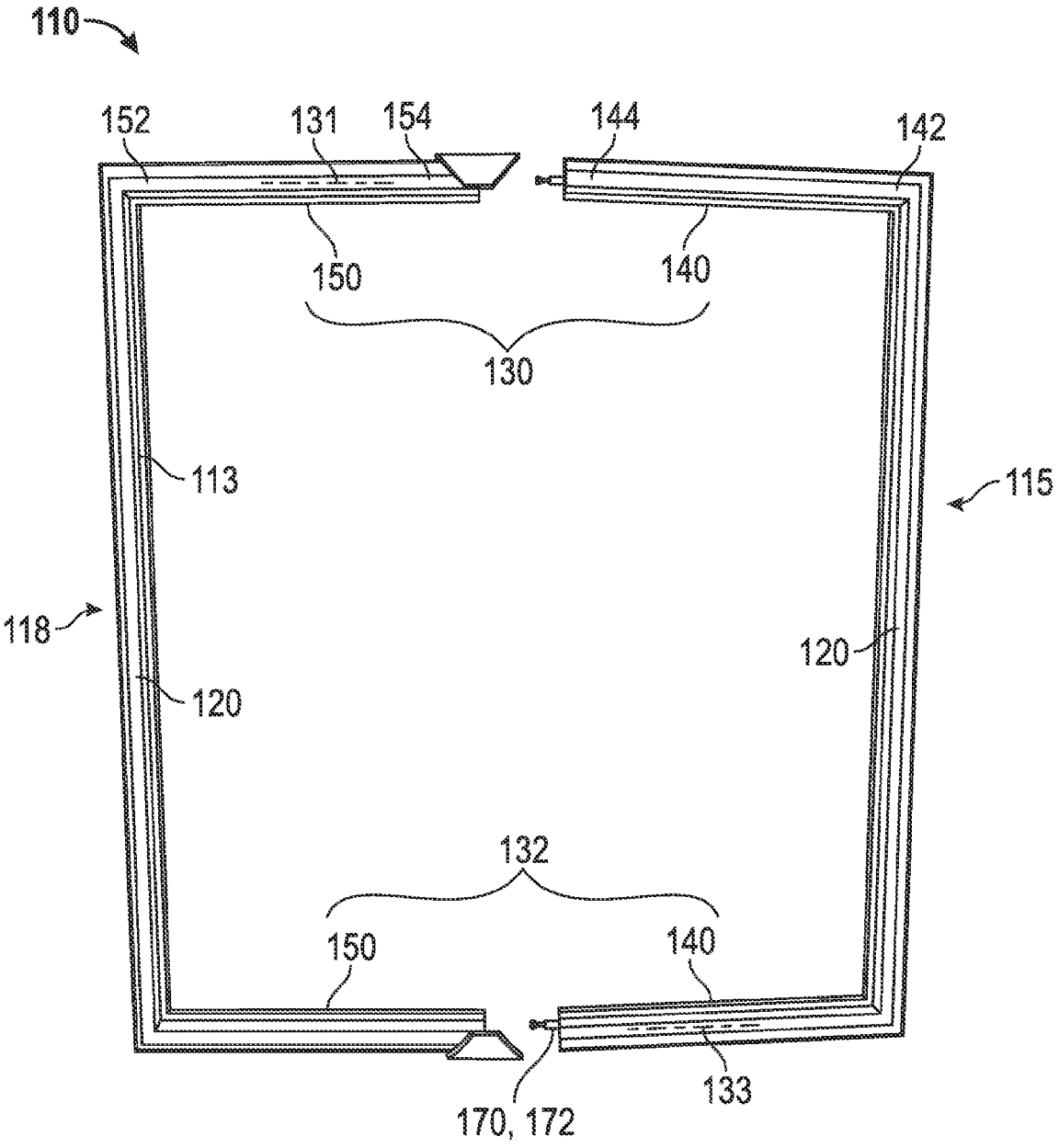
FIG. 4 is an elevation view of two C-shaped half-frames configured to form the frame assembly of FIG. 3 in accordance with principles described herein.

Referring to in FIG. 4, frame 110 is formed from multiple C-shaped partial-frames. In the embodiment shown, frame 110 is formed from two C-shaped half-frames 115, 118. The upper cross member 130 comprises a first frame portion 140 and a second frame portion 150 that are configured to couple when frame portions 140, 150 mutually extend along the first or upper member axis 131. The lower cross member 132 also comprises a first frame portion 140 and a second frame portion 150 that are configured to couple when frame portions 140, 150 mutually extend along the second or lower member axis 133. The first C-shaped half-frame 115, shown on the right side of FIG. 4, has a first side member 120 coupled to the two first frame portions 140 of cross members 130, 132. The second C-shaped half-frame 118 has a second side member 120 coupled to the two second frame portions 150 of cross members 130, 132.

Shown best in FIG. 2, the first and second frame portions 140, 150 of upper cross member 130 are joinable together at a joint 160 by a first fastener 170. The first frame portion 140 and a second frame portion 150 of lower cross member 132 are joinable together at another joint 160 by another fastener 170. In this manner, the two C-shaped half-frames 115, 118 are joinable together at the two joints 160 by the two fasteners 170. Thus, when assembled, the upper and lower cross members 130, 132 each include a first frame portion 140 coaxially aligned with a second frame portion 150 that are coupled or joined together at a joint 160 by a separate fastener 170. In the example of FIG. 2, joints 160 are located at the middle of cross members 130, 132 because, in this instance, first frame portion 140 and second frame portion 150 have equal lengths. Referring again to FIG. 4, each frame portion 140 includes a base end 142 adjacent the proximal side member 120, and a joint end 144 opposite base end 142. Each frame portion 150 includes a base end 152 adjacent the proximal side member 120, and a joint end 154 opposite base end 152. In various embodiments, two cosmetic covers 190 are optionally mounted on front surface 111 of frame 110, one to cover each joint 190. The embodiment of FIG. 4 includes a cover 190 attached to each second frame portion 150 of cross member 130 and configured to extend across a section of first portion 140.

Figure 5:
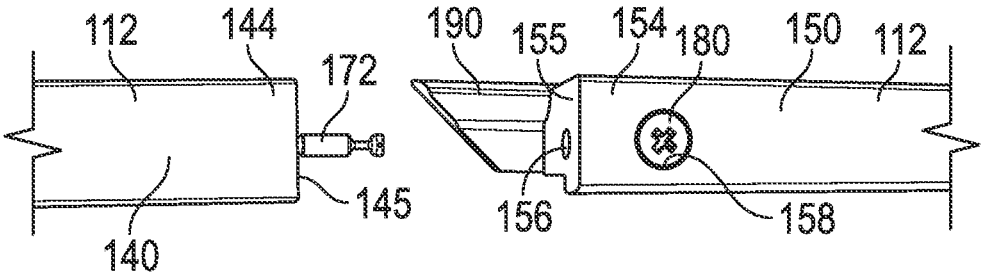
FIG. 5 is an enlarged perspective view from the rear, showing two frame portions configured to form a joint for the frame assembly of FIG. 3 in accordance with principles described herein.
Figure 6:
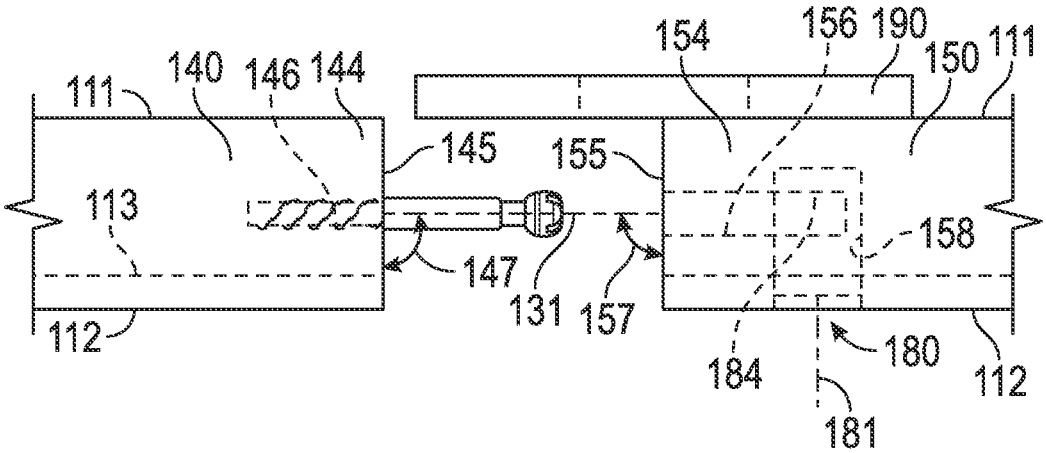
FIG. 6 is an enlarged top view of the two frame portions of FIG. 5 in accordance with principles described herein.

FIG. 5 and FIG. 6 show closer views of the two frame portions 140, 150 that are configured to form joint 160 (FIG. 2). In particular, features and components of upper cross member 130 are shown; although, the corresponding features and components of lower cross member 132 are similar. FIG. 5 gives a close perspective view from the rear while FIG. 6 gives a close top view. As best shown in FIG. 6, first frame portion 140 further includes a first joint face 145 disposed on joint end 144 positioned at a first supplementary angle 147 with respect to the member axis 131. An axial recess or bore 146 extends into frame portion 140 from first joint face 145. Second frame portion 150 further includes a second joint face 155 disposed on joint end 154 positioned at a second supplementary angle 157 with respect to the member axis 131. An axial recess or bore 156 extends into frame portion 150 from first joint face 155, and a cross-wise recess or bore 158 extends into frame portion 150 from rear surface 112 and intersects recess 156. When forming joint 160, second joint face 155 is positioned parallel to and engages first joint face 145. At least in this embodiment rear surface 112 is parallel to member axis 131, and therefore, supplementary angles 147, 157 also define the orientation of joint faces 145, 155, respectively, in relation to rear surface 112. Being a supplementary pair, the sum of angles 147, 157 equals 180 degrees. In the embodiment of FIG. 6, both supplementary angles 147, 157 are 90 degree angles.

Figure 7:
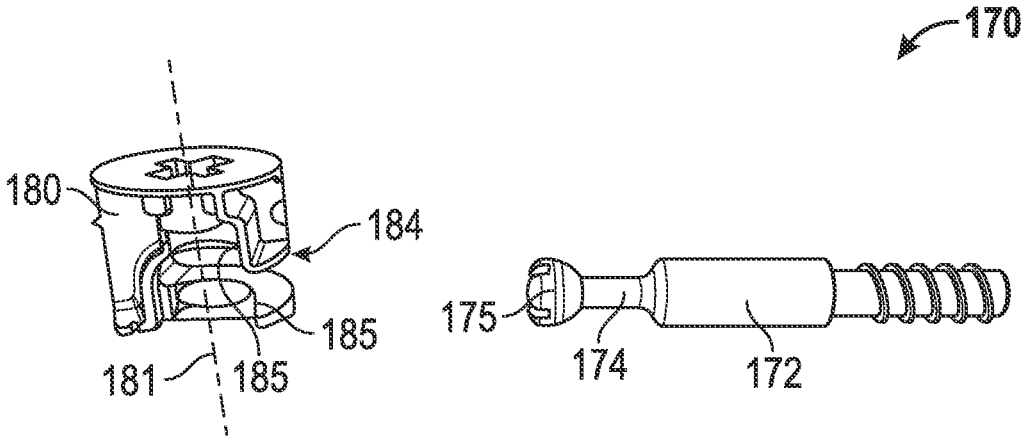
FIG. 7 is an enlarged perspective view of a fastener having two members compatible with the two frame portions of FIG. 5 in accordance with principles described herein.

Referring to FIG. 7, fastener 170 includes two inter-meshing members. The first, a pin member 172, includes a head 175 extending from a partially threaded shaft. The second, a grasping or receiving member 180, includes an axis of rotation 181, a recess 184, and a cam surface 185 configured to engage pin head 175. In the embodiment shown, fastener 170 is a two-member or two-part, camming fastener. In this embodiment, receiving member 180 includes two cam surfaces 185. Some other embodiments of frame 110 may use another configuration for fastener 170. Referring again to FIG. 6, when installed, pin member 172 is threadingly received in recess 146, extending from joint face 145 of the first frame portion 140 in a direction generally parallel to the member axis 131 and insertable into a recess 156 in the second frame portion 150. Receiving member 180 positioned in and rotatable within cross-wise recess 158 of second frame portion 150 such that recess 184 extends in a direction parallel to the member axis 131, and axis of rotation 181 is perpendicular to the member axis 131.

Figure 8:
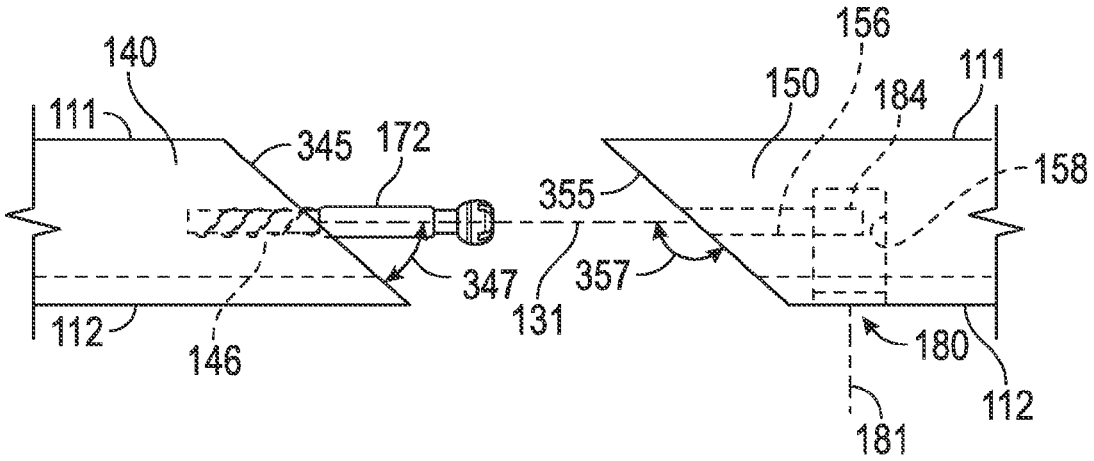
FIG. 8 is an enlarged top view of an embodiment of two frame portions configured to form a joint for the frame assembly of FIG. 3 in accordance with principles described herein.

FIG. 8 is a close top view of another embodiment of the two frame portions 140, 150 configured to form joint 160 for various embodiments of the frame assembly 110 and various embodiments of shutter assembly 100. In this embodiment, first frame portion 140 includes a first joint face 345 disposed at a first supplementary angle 347 with respect to the member axis 131. Second frame portion 150 includes a second joint face 355 disposed at a second supplementary angle 357 with respect to the member axis 131. When forming joint 160, second joint face 355 is positioned parallel to and engages first joint face 345. At least in this embodiment rear surface 112 is parallel to member axis 131, and therefore, supplementary angles 347, 357 also define the orientation of joint faces 345, 355, respectively, in relation to rear surface 112. Being a supplementary pair, the sum of angles 347, 357 equals 180 degrees. In the embodiment of FIG. 8, supplementary angle 347 is less than 90 degrees, and supplementary angle 357 is greater than 90 degrees.

Referring again to FIG. 5 and FIG. 7, receiving member 180 is engagable with the pin head 175 when pin member 172 extends into frame member recess 156 and into receiving member recess 184. When configured as described and receiving member 180 is rotated about its axis of rotation 181, cam surfaces 185 engage pin head 175, applying an axially-directed force to pin member 172. Receiving member 180 is adapted to draw together the first and second frame portions 140, 150 along member axis 131 in this manner. Referring again to FIG. 2, the first and second frame portions 140, 150 of upper cross member 130 and the frame portions 140, 150 of lower cross member 132 are separately drawn together by this procedure using separate camming fasteners 170 to create two joints 160.

Figure 9:
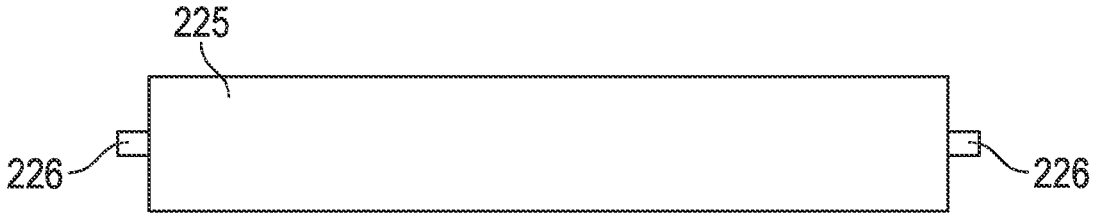
FIG. 9 is a plan view of a louver of the shutter assembly of FIG. 1 in accordance with principles described herein.

Referring again to FIG. 1, louvered panel 200 includes a panel frame 205, multiple louvers 225, and a lifting bar 228. Panel frame 205 includes a pair of parallel stiles 210 and a pair of parallel rails 220 extending between stiles 210. A shown in FIG. 9, louvers 225 are elongate and have two cylindrical axis pins 226 aligned and extending from opposing ends. In the assembled louvered panel 200 of FIG. 1, the two pins 226 rotationally couple the louver 225 between the two stiles 210, parallel to rails 220. Two hinges 230 pivotally couple the louvered panel 200 to the side member 120 of one of the two C-shaped half-frames 115, 118 that are joinable to form frame assembly 110. The two hinges 230 have a common axis of rotation 231 parallel to side member 120. An elongate member 240, which will also be called an astragal 240, is coupled to the front surface of one of the louvered panels 200 and extends lengthwise along the edge of one of the stiles 210. The astragal 240 extends from the louvered panel 200 in a transverse direction to cover a portion of the other louvered panel 200. In this embodiment, a magnetic latch (not shown) is coupled to the backside of the same panel 200 that has the astragal 240. Two ferrous stop-brackets 238 are attached to frame 110, one stop-bracket 238 on each of the cross members 130, 132. The combination of astragal 240, the magnetic latches, and the two stop-brackets 238 configure the two louvered panels 200 to be releasably retained within interior groove 113, parallel to cross members 130, 132, i.e. to be selectively held closed with respect to frame 110. Rotation of a louvered panel 200 about its axis of rotation 231 opens the panel with respect to frame assembly 110.

Figure 10:
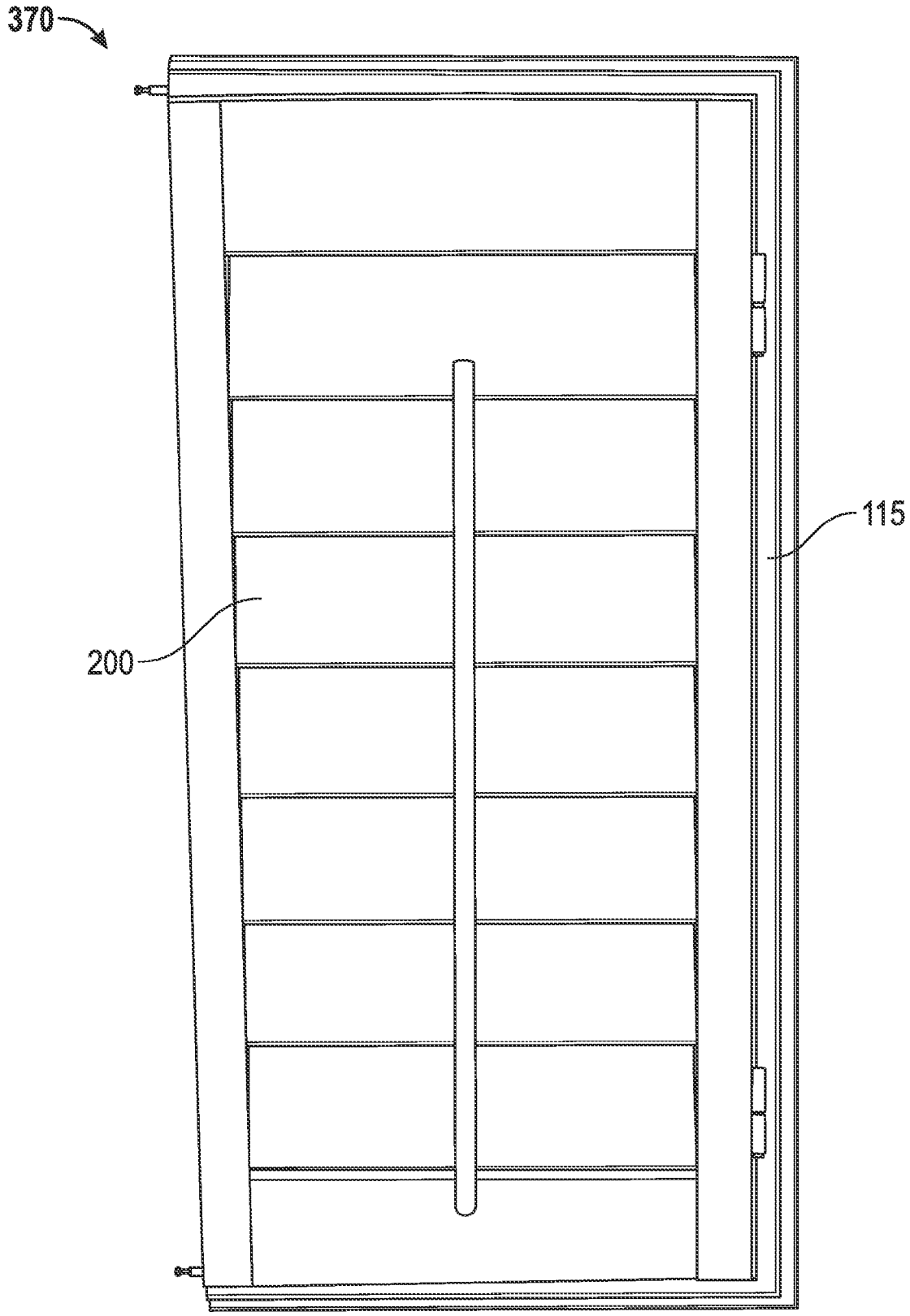
FIG. 10 is a front elevation view of a shutter sub-assembly of the shutter assembly of FIG. 1 in accordance with principles described herein.

As best shown in FIG. 10 and FIG. 1, a shutter sub-assembly 370 is formed from a louvered panel 200 coupled to the first C-shaped half frame 115, and another complementary shutter sub-assembly 370 is formed from another louvered panel 200 coupled to the second C-shaped half frame 115. The shutter assembly 100 is formable from the two attachable/detachable shutter sub-assemblies 370 coupled together by two camming fasteners 170, creating the two joints 160, shown in FIG. 2.

Figure 11:
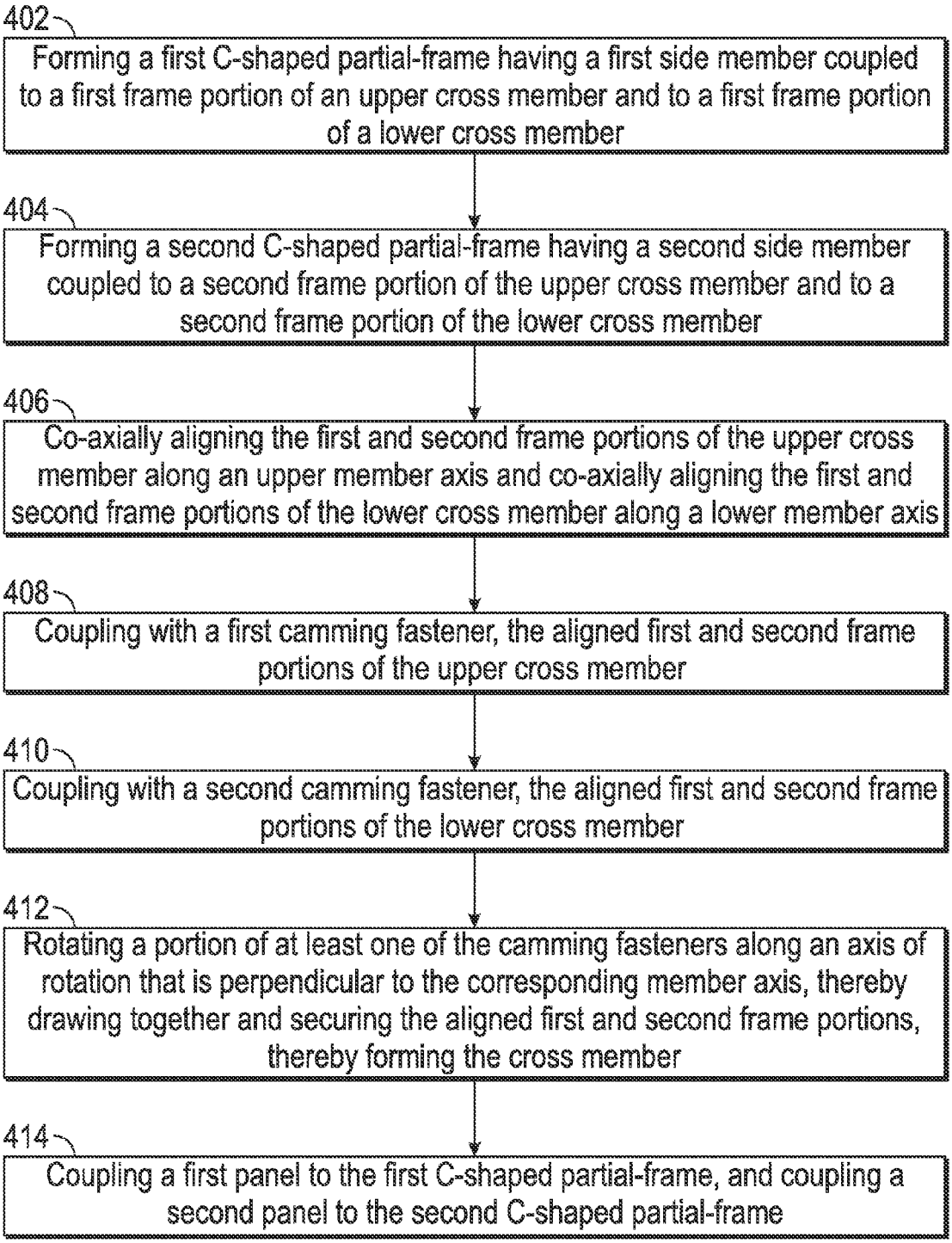
FIG. 11 presents a flow diagram showing a method for fabricating a shutter assembly in accordance with principles disclosed herein.

FIG. 11 shows several steps for a method 400 for fabricating a shutter assembly in blocks 402-412 in accordance with principles described herein. At block 402, method 400 includes forming a first C-shaped partial-frame having a first side member coupled to a first frame portion of an upper cross member and to a first frame portion of a lower cross member. Block 404 includes forming a second C-shaped partial-frame having a second side member coupled to a second frame portion of the upper cross member and to a second frame portion of the lower cross member. Block 406 involves co-axially aligning the first and second frame portions of the upper cross member along an upper member axis and co-axially aligning the first and second frame portions of the lower cross member along a lower member axis. Block 408 includes coupling with a first camming fastener, the aligned first and second frame portions of the upper cross member. Method 400 also includes a block 410 involving coupling with a second camming fastener, the aligned first and second frame portions of the lower cross member. A block 412 involves rotating a portion of at least one of the camming fasteners along an axis of rotation that is perpendicular to the corresponding member axis, thereby drawing together and securing the aligned first and second frame portions, thereby forming the cross member. A block 414 includes coupling a first panel to the first C-shaped partial-frame, and coupling a second panel to the second C-shaped partial-frame. Various embodiments of method 400 include more or fewer steps, for example, additional steps based on any of the concepts presented in this written description, including the figures. In certain embodiments, the first panel is coupled to the first C-shaped half-frame and the second panel is coupled to the second C-shaped half-frame before the two C-shaped half-frames are interconnected, i.e., before the first and second frame portions of the upper and lower cross members are secured by the camming fasteners. In this manner, in certain instances, method 400 first produces a pair of complementary shutter sub-assemblies and from these sub-assemblies forms a shutter assembly. In in accordance with principles herein, any of a variety of panels may be used in method 400, including generally flat, stylized, or louvered panels, for example.

In some instances, forming two or more complementary shutter sub-assemblies prior to forming a shutter assembly is advantageous for manufacturing, shipping, or installation purposes. For example, in some of these instances, at least one pair of complementary shutter sub-assemblies 370 will be formed in one location, and shutter assembly 100 will be formed from the pair of shutter sub-assemblies at another location, such as at the location where the shutter assembly will be installed.

Various embodiments consistent with the present disclosure have been presented. In addition, in some embodiments of shutter assembly 100, a louvered panel may include multiple sections coupled by a hinge. In some other embodiments, a unitary panel may replace the louvered panel 200. In various embodiments, the louvered panel is fabricated having cosmetic louvers; for example, the louvers are rigidly mounted to a panel frame, or the louvers are integral, forming a single unit with the panel frame. In certain other embodiments, the louvered panel 200 is replaced by a panel having no louvers. Although shutter assembly 100 and frame assembly 110 have been shown as rectangular, in various embodiments, a shutter assembly or a frame assembly that is fabricated in accordance with principles described herein is configured to fit a non-rectangular window or door frame, such as a hexagonal window casing. In some instances, to accomplish an aesthetic, economic, scheduling, or functional advantage, a frame assembly 110 or a shutter assembly 100, or any such embodiment, may be coupled to an opening, a casing or another frame in a building even though the opening, casing, or other frame has no window or door. In some instances, a frame assembly 110 or a shutter assembly 100, or any such embodiment, may function as a casing or as a door, respectively.

While exemplary embodiments have been shown and described, modifications thereof can be made by one of ordinary skill in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. The inclusion of any particular method step or action within the written description or a figure does not necessarily indicate that the particular step or action is necessary to the method. Unless expressly stated otherwise, the steps listed in a description of a method or in a method claim may be performed in any order, and in some instances two or more of the method steps may be performed in parallel, rather than serially.

What is claimed is:

1. A frame assembly comprising:

a pair of side members; and a pair of generally parallel cross members extending between the side members and spaced apart from one another, a first cross member of the pair extending along a first member axis, and a second cross member of the pair extending along a second member axis that is spaced apart from the first member axis;

wherein at least the first cross member comprises a first frame portion and a second frame portion that extend generally along the first member axis, the first and second frame portions being joinable together at a joint by a first fastener, the fastener comprising:

a pin member extending from the end of the first frame portion in a direction generally parallel to the first member axis and insertable into a recess in the second frame portion;

a receiving member having a cam surface engagable with the pin member and being mounted in and rotatable within the second frame portion and adapted to draw together the first and second frame portions when the receiving member is rotated while engaging the pin member; and wherein the joint is disposed generally in the middle of the first cross member.

2. The frame assembly of claim 1 wherein each cross member comprises a first and a second coaxially aligned frame portion that are joinable together at a joint by a separate fastener;

wherein the first side member couples to the two first frame portions, one from each of the cross members to form a first C-shaped partial-frame;

wherein the second side member couples to the two second frame portions, one from each of the cross members to form a second C-shaped partial-frame;

wherein the two C-shaped partial-frames are joinable together at the two joints by the two fasteners.

3. The frame assembly of claim 2 further comprising at least one panel pivotally coupled to a side member of one of the C-shaped partial-frames.

4. The frame assembly of claim 3 wherein the at least one panel is a louvered panel comprising:

a panel frame; and at least one louver pivotally coupled within the panel frame.

5. The frame assembly of claim 1 wherein the receiving member has a recess configured to engage a portion of the pin member; and wherein the receiving member is positioned in a frame portion such that the recess extends in a direction parallel to the first member axis.

6. The frame assembly of claim 1 wherein the receiving member is rotatable relative to the second frame portion about an axis of rotation; and wherein the axis of rotation is perpendicular to the first member axis.

7. A shutter assembly comprising:

a frame; and at least one panel pivotally coupled to the frame;

wherein the frame comprises:

a pair of side members; and a pair of generally parallel cross members extending between the side members and spaced apart from one another, a first cross member of the pair extending along a first member axis, and a second cross member of the pair extending along a second member axis that is spaced apart from the first member axis;

wherein each cross member comprises a first frame portion and a second frame portion, the first and second frame portions of each cross member being joined together generally at the middle of the cross member at a joint held by a camming fastener;

wherein each camming fastener comprises a receiving member that is adapted for rotation about an axis of rotation perpendicular to the first member axis and that is adapted to draw together the first and the second frame portions when the receiving member is rotated and to secure the first and second frame portions to be generally aligned with the member axis;

wherein the first side member couples to a first louvered panel and also to the two first frame portions to form a first shutter sub-assembly;

wherein the second side member couples to a second louvered panel and also to the two second frame portions to form a second shutter sub-assembly; and wherein the two shutter sub-assemblies are joinable and separable at the two joints by the two camming fasteners.

8. The shutter assembly of claim 7 wherein for the first cross member, the camming fastener further comprises a pin member extending from the end of the first frame portion in a direction generally parallel to the first member axis and insertable into a recess in the second frame portion;

wherein the receiving member has a recess configured to engage a portion of the pin member; and wherein the receiving member is positioned in the second frame portion of the cross member such that the recess extends in a direction parallel to the first member axis.

9. The shutter assembly of claim 7 wherein for the first cross member, the first frame portion and the second frame portion have equal lengths.

* * * * *